US006460570B1

(12) United States Patent
Jones et al.

(10) Patent No.: US 6,460,570 B1
(45) Date of Patent: Oct. 8, 2002

(54) SPRAY FAUCET HOSE WEIGHT

(75) Inventors: Jacob Jones, West Lafayette; Kurt Thomas, Greenwood, both of IN (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/852,694

(22) Filed: May 10, 2001

(51) Int. Cl.[7] ..... E03C 1/02
(52) U.S. Cl. ..... 137/801; 138/103; 239/588
(58) Field of Search ..... 137/801; 138/103; 239/588

(56) References Cited

U.S. PATENT DOCUMENTS 5,090,062 A 2/1992 Hochstrasser
5,361,431 A 11/1994 Freier et al.
5,771,934 A 6/1998 Warshawsky
5,960,832 A 10/1999 Warshawsky
6,250,338 B1 * 6/2001 Dempsey ..... 137/801

* cited by examiner

*Primary Examiner*—Gerald A. Michalsky
(74) *Attorney, Agent, or Firm*—Carlson Gaskey & Olds

(57) ABSTRACT

A faucet assembly having a spray nozzle connected to a spray hose. A weight attached to the spray hose provides a downward force to nest the spray nozzle. The weight includes an open channel extending longitudinally across a length of the weight and two members having external threads extending from the weight and positioned on opposing sides of the open channel. A hex nut including internal threads engages the external threads of the two members, such that the fastener extends over the open channel to secure the weight onto the spray hose.

18 Claims, 3 Drawing Sheets

SPRAY FAUCET HOSE WEIGHT

BACKGROUND OF THE INVENTION

This invention relates to a weight for a faucet spray hose attachment.

Typically, a spray hose attachment includes a hose attached to a water supply at a first end and a spray nozzle at a second end. The hose is hidden below a sink and extends through an opening in the sink when the spray nozzle is pulled from a nest disposed on the sink. A weight is attached to the hose to provide a downward force to hold and return the spray nozzle in the nest when not in use. Conventional weights include two pieces with a channel extending longitudinally across each weight. Threaded fasteners secure the two pieces of the weight together and trap the hose therebetween. Installation of the weights in the typical two-piece design is awkward because the threaded fasteners must be inserted through one piece and threaded into the other piece while holding both pieces in proper alignment along the hose. Therefore it is desirable to design a weight that simplifies assembly. A further design goal is the reduction of cost. The hose weight is not a visible element of the faucet and therefore it is desirable to reduce the cost of the weight.

For these reasons it is desirable to develop a low cost alternative to the conventional weight design to simplify positioning and assembly of the weight to the spray hose.

SUMMARY OF THE INVENTION

The invention is a weight assembly attached to a water supply hose of a faucet assembly having a spray nozzle.

The weight assembly includes an open channel extending longitudinally across a length of the weight and open at each end such that the spray hose is disposed within the open channel. In the preferred embodiment a pair of semicircular members extend upwardly on opposing sides of the open channel. Each of the members includes threads that correspond between each member such that a fastener having internal threads can be threaded onto the circular members and tightened against the spray hose. In another embodiment of the subject invention, the weight includes two pairs of slots that are arranged on opposite sides of the open channel. A clip snap fits into each of the slots to secure and position the weight onto the spray hose.

The weight assembly of this invention provides a low cost alternative to simplify and ease positioning and assembly of the weight to the spray hose.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
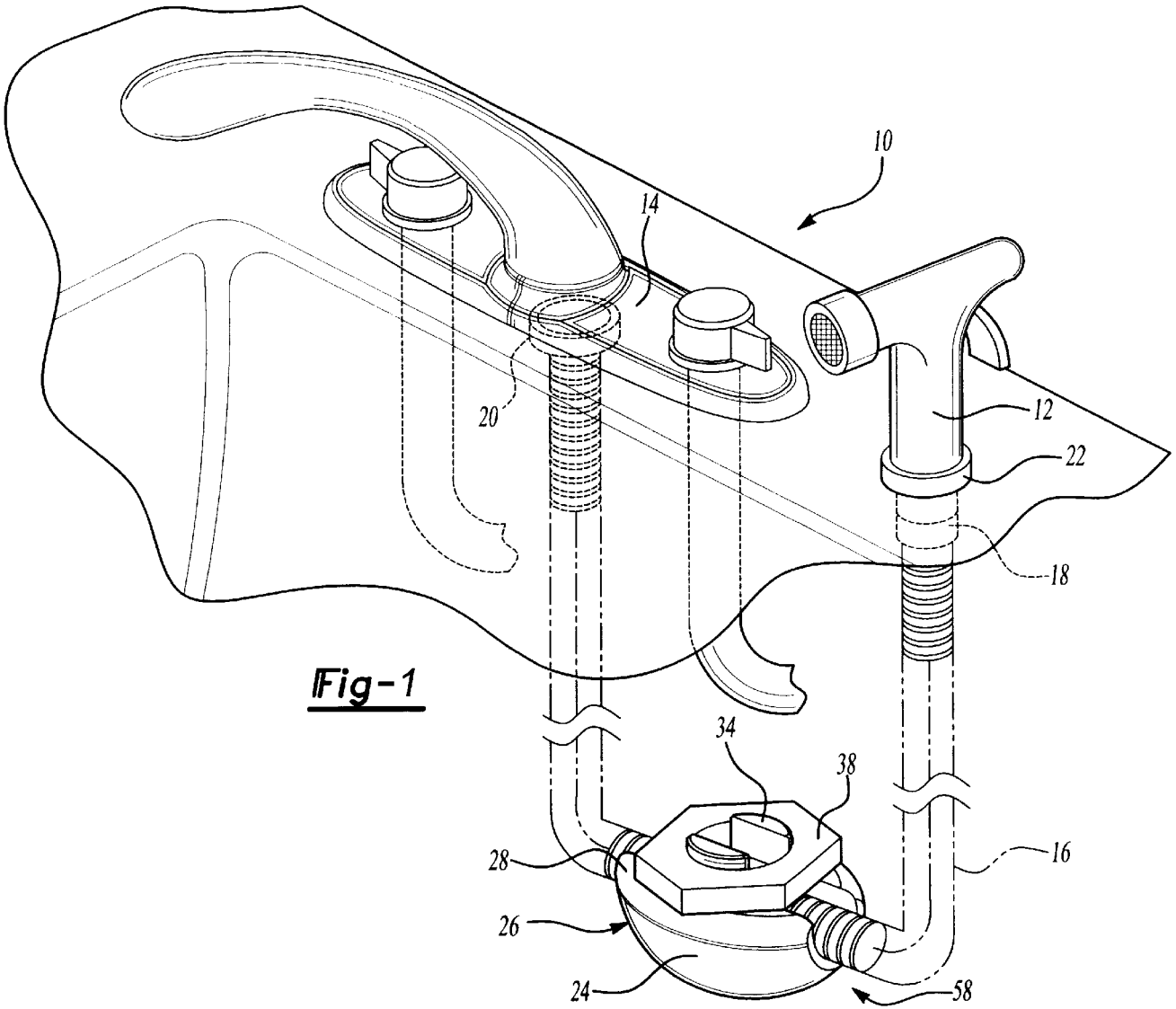
FIG. 1 is a cut away view of a kitchen faucet including a spray nozzle and hose with a weight.

Referring to the Figures, wherein like numerals indicate like or corresponding parts throughout the several views, the invention is a weight attached to a spray hose of a faucet assembly. The faucet assembly is generally shown at 10 in FIG. 1 and includes a spray nozzle 12 supplied with water from the main faucet assembly 10 by way of a hose 16. The hose includes a first end 18 attached to the spray nozzle 12 and a second end 20 attached to the main faucet assembly 14. The spray nozzle 12 seats within a nest 22 mounted on the sink 23. A weight 24 is disposed on the hose 16 at the bottom of a curve 58 to provide a downward force on the hose 16 to firmly hold the spray nozzle 12 within the nest 22.

Figure 2:
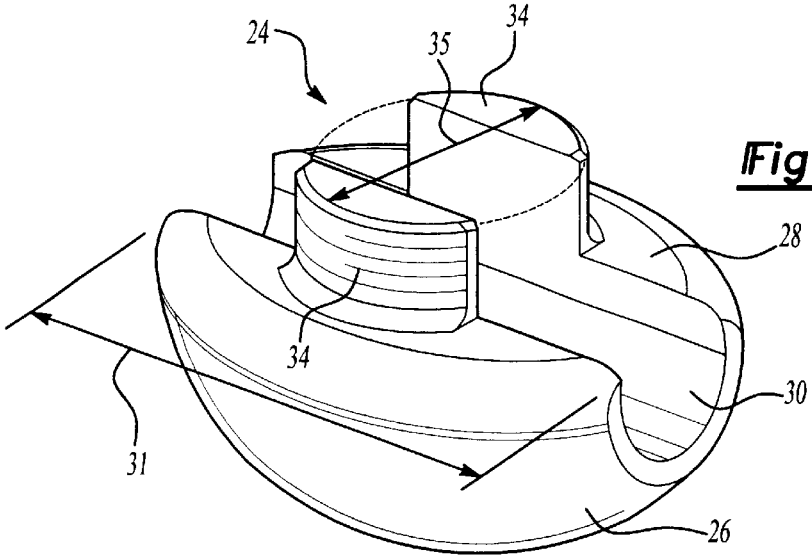
FIG. 2 is a perspective view of the weight without the fastening nut.
Figure 3:
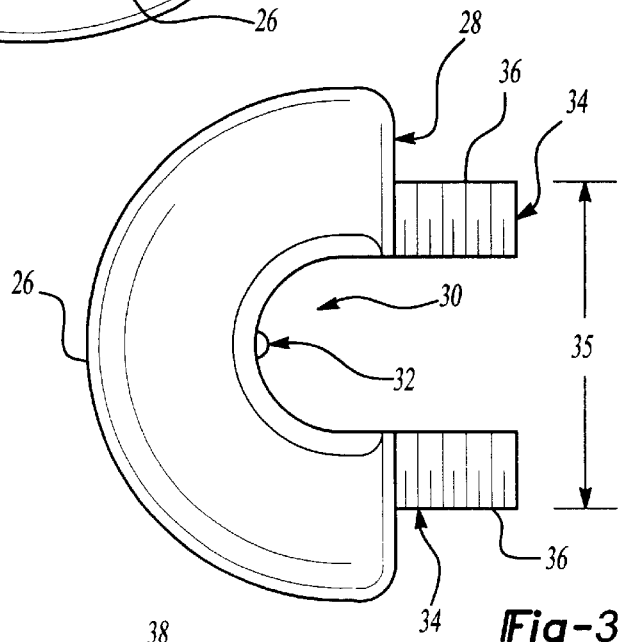
FIG. 3 is a cross-sectional view of the weight.

Referring to FIG. 2 and 3, the weight 24 includes a curved side 26 and a flat side 28. The flat side 28 includes an open channel 30 extending across a length 31 of the weight 24. The hose 16 is secured within the open channel 30. Preferably, disposed within the open channel 30 are projections 32 to engage the hose 16 and prevent the hose 16 from slipping. Two members 34 extend from the flat side 28 on opposing sides of the open channel 30. The two members 34 are semi-circular and form the outlying portions of a diameter 35. Preferably the two members 34 include external threads 36 that correspond to the threads 36 of the other member 34 such that the external threads 36 would form a continually threaded member, but for the open channel 30 for the spray hose 16 disposed therebetween.

Figure 4:
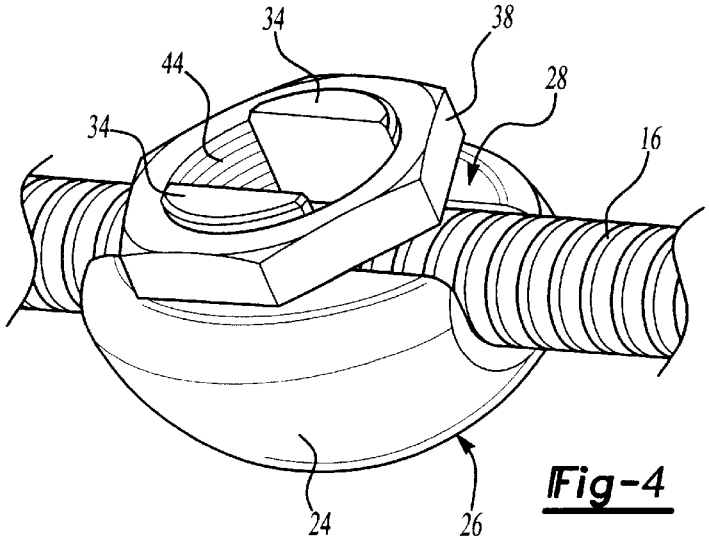
FIG. 4 is a perspective view of the weight with the fastening nut.

Referring to FIG. 4, a fastener 38 having internal threads 44 for engaging the external threads 36 is disposed on the members 34. Preferably, the fastener 38 is a hexagonally shaped nut, such that a wrench or similar tool can be used to tighten the fastener 38 down to the flat side 28 of the weight 24 and against the spray hose 16. Preferably, the open channel 30 is sized such that the fastener 44 will apply sufficient pressure onto the hose 16 to secure and position the weight 24 without supplying such excess pressure that would crush and damage the hose 16. Preferably the hex nut 44 is fabricated from a brass material that provides corrosion resistance. A worker knowledgeable in the art will understand that various other suitable materials may be utilized for the fabrication of the fastener 44.

Further, although the preferred embodiment includes two members 34 having external threads, it is within the contemplation of this invention that a thread cutting fastener can be used such that the external threads do not have to be machined into the weight 24.

Figure 5:
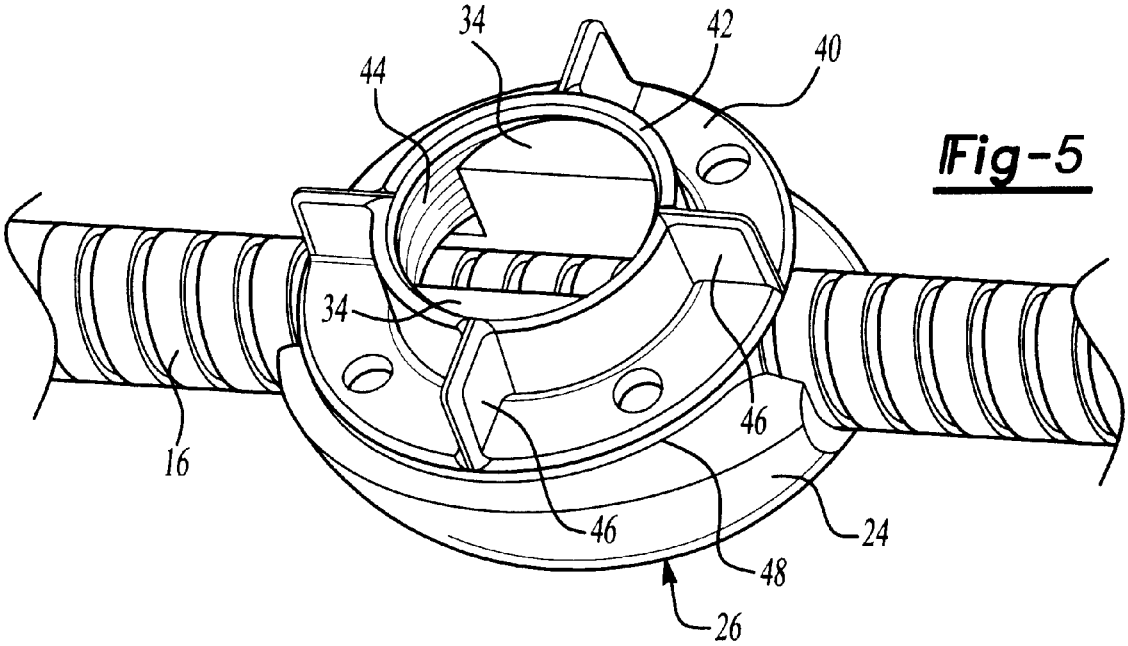
FIG. 5 is a perspective view of the weight with another embodiment of the fastening nut.

Referring to FIG. 5, another embodiment of a fastener 40 is shown. In this embodiment the fastener 40 is molded plastic and is formed such that no tools are required for installation to the members 34. The plastic fastener includes a central circular portion 42 having internal threads 44 to engage the external threads 36 of the members 34. A plurality of ribs 46 extends from the central circular portion 42 toward a circumference 48 of the plastic fastener 40. The ribs 46 can be used to tighten the plastic fastener 40 down toward the flat surface 28 of the weight 24 and against the spray hose 16.

Figure 6:
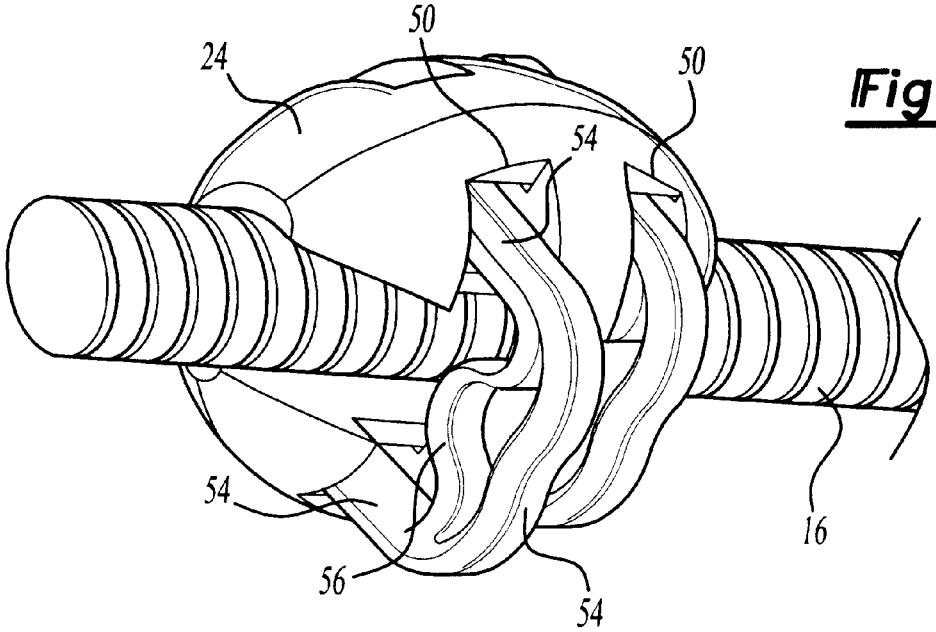
FIG. 6 is perspective view of another embodiment of the weight.

Referring to FIG. 6, an alternate means of securing the weight 24 is shown. In this embodiment the weight 24 includes two pairs of slots 50. Each of the pair of slots 50 is disposed on an opposed side of the open channel 30 and extend through the weight 12. A clip 52 extends across the open channel 30 and snaps into the slots 50. Each clip 52 includes two legs 54 connected by a center portion 54. The legs 54 snap fit into the slots 50 and the center portion 54 includes a spring portion 56 that engages the spray hose 12 to apply sufficient pressure to hold and position the spray hose 16 within the open channel 30. The preferred embodiment includes a pair of clips 52, however a worker knowledgeable in the art will recognize that the number of clips 52 can vary depending on the specific application and size of the weight.

The weight 24 is preferably fabricated from a zinc alloy, however other materials, such as plastic or metal, can be used. The zinc alloy is preferable over more expensive materials because of the favorable cost benefits.

The weight 24 provides sufficient downward force on the hose 16 to firmly hold the spray nozzle 12 within the nest 22 while being easily extendable from the nest 22 for use. Referring to FIG. 1, the weight 24 is positioned on the hose 16 at a point near the bottom part 58 of a curve in the of the hose 16 such that sufficient length is available for use, while positioning the weight 24 in such a manner as to most efficiently exert the required downward force to hold the spray nozzle 12 in the nest 22. Further, the weight is positioned to prevent over extension of the hose 16, that can damage or kink the hose 16 at the water connection.

The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention maybe practiced otherwise than as specifically described. For that reason the following claims should be studied to determine the true scope and content of this invention.

What is claimed is:

1. A weight assembly for a faucet having a hose attached to a spray nozzle, said assembly comprising, a weight having a first side defining a plane and an open channel extending longitudinally across said weight and including a depth such that greater than half of the hose is disposed below said plane; and a fastener attachable to said weight extending across said open channel to secure and position said weight on the hose.

2. The assembly of claim 1, wherein said fastener attaches to members extending from said weight and disposed on opposing sides of said open channel.

3. The assembly of claim 2, wherein said members include external threads and said fastener includes internal threads that mate to said external threads.

4. The assembly of claim 3, wherein said fastener includes a plurality of ribs extending from a central portion including said internal threads.

5. The assembly of claim 1, wherein said weight includes slots disposed on opposing sides of said open channel and a clip to engage said slots to secure and position said weight on the hose.

6. The assembly of claim 5, wherein said clip includes legs to engage said slots, and a center section for engaging the spray hose.

7. A faucet assembly having a spray nozzle, said faucet assembly comprising;

a spray hose connected to the spray nozzle;

a weight attached to said spray hose having a first side defining a plane and an open channel extending longitudinally across said weight, said hose is secured within said open channel with greater than half of said hose below said plane; and a fastener attachable to said weight extending across said open channel to secure and position said weight on said spray hose.

8. The assembly of claim 7,wherein said fastener attaches to members extending from said weight and disposed on opposing sides of said open channel.

9. The assembly of claim 8 wherein said members include external threads and said fastener includes internal threads that mate to said external threads.

10. The assembly of claim 9, wherein said fastener is a hex nut.

11. The assembly of claim 10, wherein said fastener includes a plurality of ribs extending from a central portion having said internal threads.

12. The assembly of claim 7, wherein said weight includes slots disposed on opposing sides of said open channel and a clip to engage said slots to secure and position said weight.

13. The assembly of claim 12, wherein said clip includes legs to engage said slots, and a center section for engaging said spray hose.

14. A faucet assembly having a spray nozzle, said faucet assembly comprising a spray hose connected to the spray nozzle at a first end and to a water source at a second end;

a weight attached to said spray hose and having an open channel extending longitudinally across a length of said weight and two members having external threads extending from said weight and disposed on opposing sides of said open channel; and a fastener including internal threads that threadingly engage said external threads of said members, such that said fastener extends over said open channel to secure said weight onto said spray hose.

15. The assembly of claim 14, wherein said fastener is a hex nut.

16. The assembly of claim 14, wherein said fastener includes a plurality of ribs extending from a central portion having said internal threads.

17. A weight assembly for a faucet having a hose attached to a spray nozzle, said assembly comprising, a weight having an open channel extending longitudinally across said weight within which the hose is disposed; and a threaded fastener attachable to said weight extending across said open channel to secure and position said weight on the hose.

18. A faucet assembly having a spray nozzle, said faucet assembly comprising;

a spray hose connected to the spray nozzle;

a weight attached to said spray hose and having an open channel extending longitudinally across said member and said hose is secured within said open channel; and a threaded fastener attachable to said weight extending across said open channel to secure and position said weight on said spray hose.

* * * * *